US006494293B1

(12) United States Patent
Jung

(10) Patent No.: US 6,494,293 B1
(45) Date of Patent: Dec. 17, 2002

(54) OPENING AND CLOSING SYSTEM FOR OIL PATH OF LINEAR COMPRESSOR

(75) Inventor: Won Hyun Jung, Kyungsangnam-Do (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/582,732

(22) PCT Filed: Dec. 11, 1998

(86) PCT No.: PCT/KR98/00421

§ 371 (c)(1),
(2), (4) Date: Aug. 14, 2000

(87) PCT Pub. No.: WO00/26536

PCT Pub. Date: May 11, 2000

(30) Foreign Application Priority Data

Nov. 4, 1998 (KR) ..... 98-47110

(51) Int. Cl.[7] ..... F01M 1/00
(52) U.S. Cl. ..... 184/6.16; 417/211; 417/415
(58) Field of Search ..... 184/6.16; 417/415, 417/417, 211

(56) References Cited

U.S. PATENT DOCUMENTS 5,816,783 A * 10/1998 Oshima et al. ..... 417/415
5,993,175 A * 11/1999 Kim et al. ..... 417/417
6,089,352 A * 7/2000 Kim et al. ..... 184/6.16
6,202,791 B1 * 3/2001 Oh et al. ..... 184/6.16
6,220,393 B1 * 4/2001 Oh et al.
6,299,421 B1 * 10/2001 Oh et al. ..... 417/571

* cited by examiner

*Primary Examiner*—David Fenstermacher
(74) *Attorney, Agent, or Firm*—Ostrolenk, Faber, Gerb & Soffen, LLP

(57) ABSTRACT

An opening and closing system for an oil path of a linear compressor that facilitates smooth oil supply during the operation of the compressor and has the oil which has been supplied to the compressor partly remained therein when suspending the operation of the compressor for smooth lubrication when re-operating the compressor includes a hermetic vessel in which oil is filled in a bottom part thereof, a frame disposed in the hermetic vessel and communicating with a first oil groove and a second oil groove, a cylinder inserted into a through hole formed in a predetermined portion of the frame, a piston linearly reciprocating by the driving of a motor by being inserted into the cylinder, the second oil groove being formed on a portion of an outer circumferential surface of the piston, an exhaust cover coupled to one side of the cylinder, an oil supplier disposed at the frame for pumping out oil and communicating with the first oil groove through an oil inflow path, and a switching means formed between the first oil groove and the oil inflow path for opening and closing the oil inflow path.

12 Claims, 5 Drawing Sheets

OPENING AND CLOSING SYSTEM FOR OIL PATH OF LINEAR COMPRESSOR

TECHNICAL FIELD

The present invention relates to a linear compressor, and more particularly to an opening and closing system for an oil path of a linear compressor capable of facilitating smooth oil supply during operation of the compressor and smooth lubrication by an oil which remains in the compressor when re-operating the compressor by having the supplied oil partly remained therein when the operation of the compressor is suspended.

BACKGROUND ART

Recently, as in home appliances such as a refrigerator and an air-conditioner, etc. high-efficiency and power-saving products have been produced, the study for developing a compressor constituting a refrigerating cycle machine which is installed in a refrigerator or an air-conditioner is also being lively made.

A linear compressor, which is one of the compressors for sucking and compressing low-pressure air and exhausting the compressed air at high pressure, is illustrated in FIG. 1.

As shown therein, the linear compressor includes a hermetic vessel 1 in which a predetermined amount of oil is filled, a frame 10 formed in a predetermined shape and disposed in the hermetic vessel 1, a cylinder 20 inserted into the frame 10, an inner stator assembly 30 coupled with one side portion of the frame 10 for constituting a motor, an outer stator assembly 31 coupled with the inner stator assembly 30 at a predetermined distance, a magnet 32 inserted between the inner and outer stator assemblys 30, 31, and a piston 40 inserted into the cylinder 20 and coupled to a magnet frame 33 to which the magnet 32 is fixedly connected, and reciprocating in accordance with the linear movement of the magnet 32, wherein there is formed a refrigerant oil path F in the piston 40 through which a refrigerant gas is flowed.

Further, a predetermined-shaped cover 50 is engaged to the other side of the frame 10, and at an inner part of the cover 50 a main spring 51 is provided at both sides of the magnet frame 33 coupled to the piston 40 and thus elastically supports the reciprocation of the piston 40.

While, an exhaust cover 60 formed in a cap type is coupled to one side of the cylinder 20 and an exhaust valve assembly 61 is insertedly disposed in an inner portion of the exhaust cover 60, the exhaust valve assembly 61 switching the one side of the cylinder 20, an suction valve 62 which switches according to the suction of the gas is coupled to an end portion of the piston 40, and an oil supplier 70 which supplies oil to components to be slid to each other is disposed at a lower part of the frame 10.

In the operation of the conventional linear compressor, when an electric current is applied to the motor, the magnet 32 linearly reciprocates and the linear movement accordingly travels through the magnet frame 33 to the piston 40 which also accordingly reciprocates in the cylinder 20.

Here, the refrigerant gas which is flowed into the hermetic vessel 1 in accordance with the linear operation of the piston 40 is flowed into the cylinder 20 through the refrigerant oil path F provided in the piston 40, compressed therein and then exhausted through the exhaust valve assembly 61 and the exhaust cover 60, the above process being repeatedly performed.

Further, in order to achieve the smooth sliding performed while the piston 40 is being reciprocating in the cylinder 20 and also to radiate the heat generated during the compression of the refrigerant gas, the oil pumped out by the oil supplier 70 is supplied to components, for example, which are disposed between the cylinder. 20 and the piston 40.

Here, in the oil supply system in which the oil pumped out by the oil supplier 70 circulates, a first oil groove 12 is formed at predetermined size on a portion of an inner circumferential surface of a through hole 11 of the frame 10 to which the cylinder 20 is inserted, a second oil groove 41 is formed at predetermined size on a portion of an outer circumferential surface of the piston 40 inserted into the cylinder 20, and an oil pass hole 21 is provided in the cylinder 20 so that the first oil groove 12 communicates with the second oil groove 41. In addition, a ring-shaped oil circular path 13 is formed by the exhaust cover 60 connected with an outer circumferential portion of the cylinder 20, the through hole 11 and the cylinder 20 when the cylinder 20 is inserted into the through hole 11 of the frame 10, the oil circular path 13 communicating with the first oil groove 12 through an oil communicating path 14 formed on a portion of the inner circumferential surface of the through hole 11.

Further, an oil inflow path 15 is formed at a portion of the frame 10 so that the oil pumped out in the oil supplier 70 is flowed to the first oil groove 12, and an oil discharge hole 17 is formed at a side portion of the oil circular path 13 so as for the oil which has circulated through the oil circular path 13 to be discharged to a bottom part of the hermetic vessel 1.

In the thusly described oil supply system of the convention linear compressor, as shown in FIG. 2, in the operation of the compressor, when the oil is pumped out in the oil supplier 70 due to vibrations generated in the process of which the compressor compresses the refrigerant gas while reciprocating, the pumped oil is flowed into the first oil groove 12 through the oil inflow path 15 and then flowed to the oil pass hole 21 and the second oil groove 41, so that the flowed oil serves as a lubricant between the piston 40 and the cylinder 20 and also refrigerates the heat generated from the motor.

Further, the oil passed through the first and second oil grooves 12, 41 is flowed into the oil circular path 13 through the oil communicating path 14, heated parts of the exhaust cover 60 and the cylinder 20 are refrigerated by the refrigerant gas which is exhausted when the oil flowed to the path 13 circulates through the oil circular path 13, and the oil flowed to the oil circular path 13 drops to the bottom part of the hermetic vessel 1 in which a predetermined amount of oil is filled and such oil continuously circulates by the above-described process.

In addition, numerals 34 and 2 denote a coil assembly and a suction pipe, respectively.

However, when the operation of the compressor is suspended, the oil being supplied is returned to the bottom part of the vessel 1 due to its self weight. Therefore, when the compressor is restarted to operate in such condition, no oil remains in a portion, for example, between the cylinder and the piston where friction occurs, and thus the operation is performed in a non-lubricative state, which results in abrasion of the components in the system as well as friction loss and also becomes a problem of generation of overload in the initial state of the re-operation.

Further, when the pressure of a compression chamber which compresses the gas increases as the piston moves to a top dead center by the driving of the motor, the high-pressure refrigerant gas may leak from a gap between the piston and the cylinder and be flowed into the oil path. In this case, when the high-pressure refrigerant gas is flowed to the oil supplier side, there is produced noises caused by, for example, a cavitation.

DISCLOSURE OF THE INVENTION

Accordingly, an object of the present invention is to provide an opening and closing system for an oil path of a linear compressor that facilitates smooth oil supply during the operation of the compressor and has the oil which has been supplied to the compressor partly remained therein when suspending the operation of the compressor for smooth lubrication when re-operating the compressor. To achieve the above object, there is provided an opening and closing system for an oil path of a linear compressor which includes a hermetic vessel in which oil is filled in a bottom part thereof, a frame disposed in the hermetic vessel and communicating with a first oil groove and a second oil groove, a cylinder inserted into a through hole formed in a predetermined portion of the frame, a piston linearly reciprocating by the driving of a motor by being inserted into the cylinder, the second oil groove being formed on a portion of an outer circumferential surface of the piston, an exhaust cover coupled to one side of the cylinder, an oil supplier disposed at the frame for pumping out oil and communicating with the first oil groove through an oil inflow path, and a switching means provided between the first oil groove and the oil inflow path for opening and closing the oil inflow path.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

With reference to the accompanying drawings, an opening and closing system for an oil path of a linear compressor according to the present invention will be described in detail. Here, the components which are the same as those of the conventional art are labelled with the same reference numbers.

Figure 1:
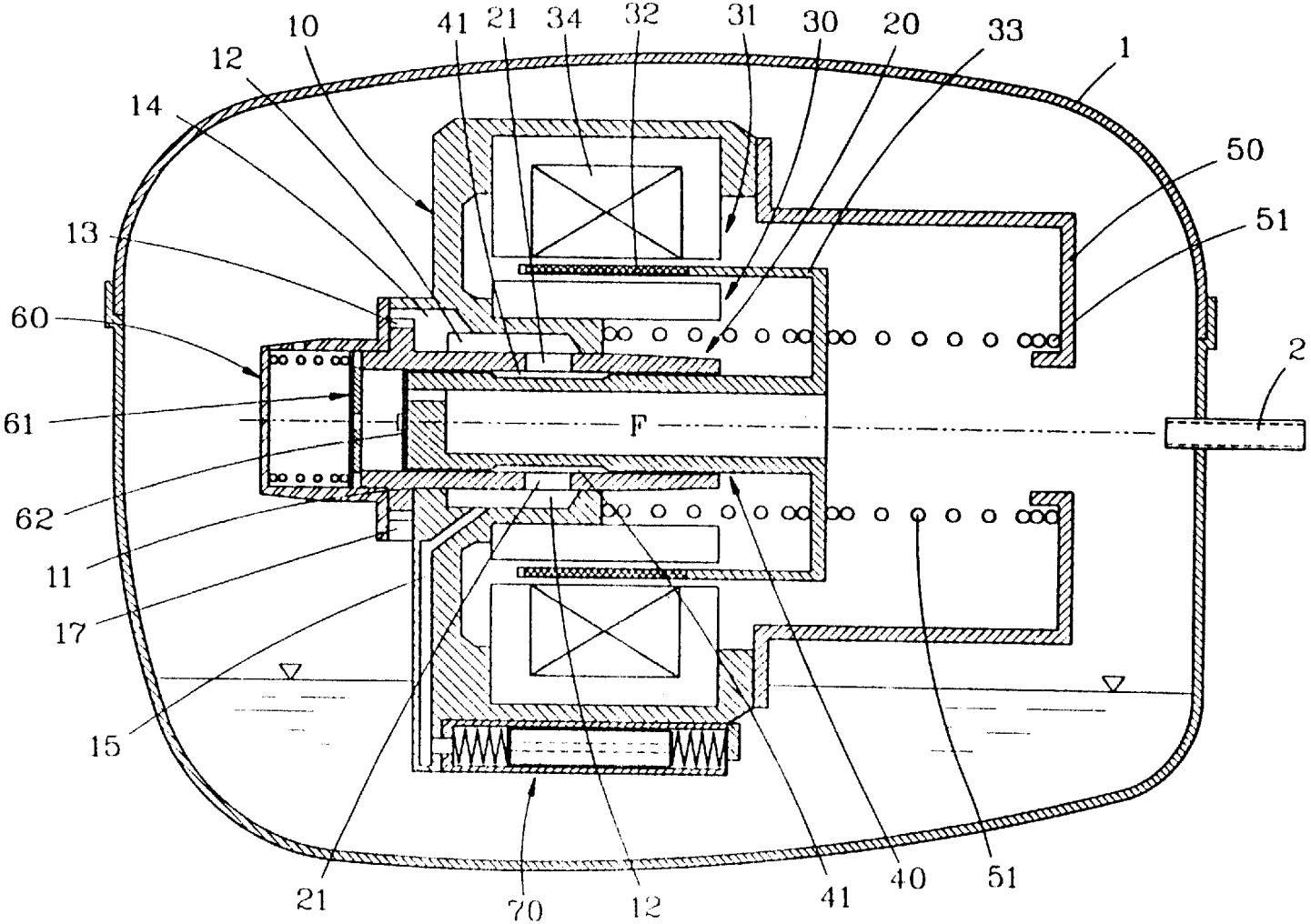
FIG. 1. is a cross-sectional view illustrating an example of a conventional linear compressor.
Figure 2:
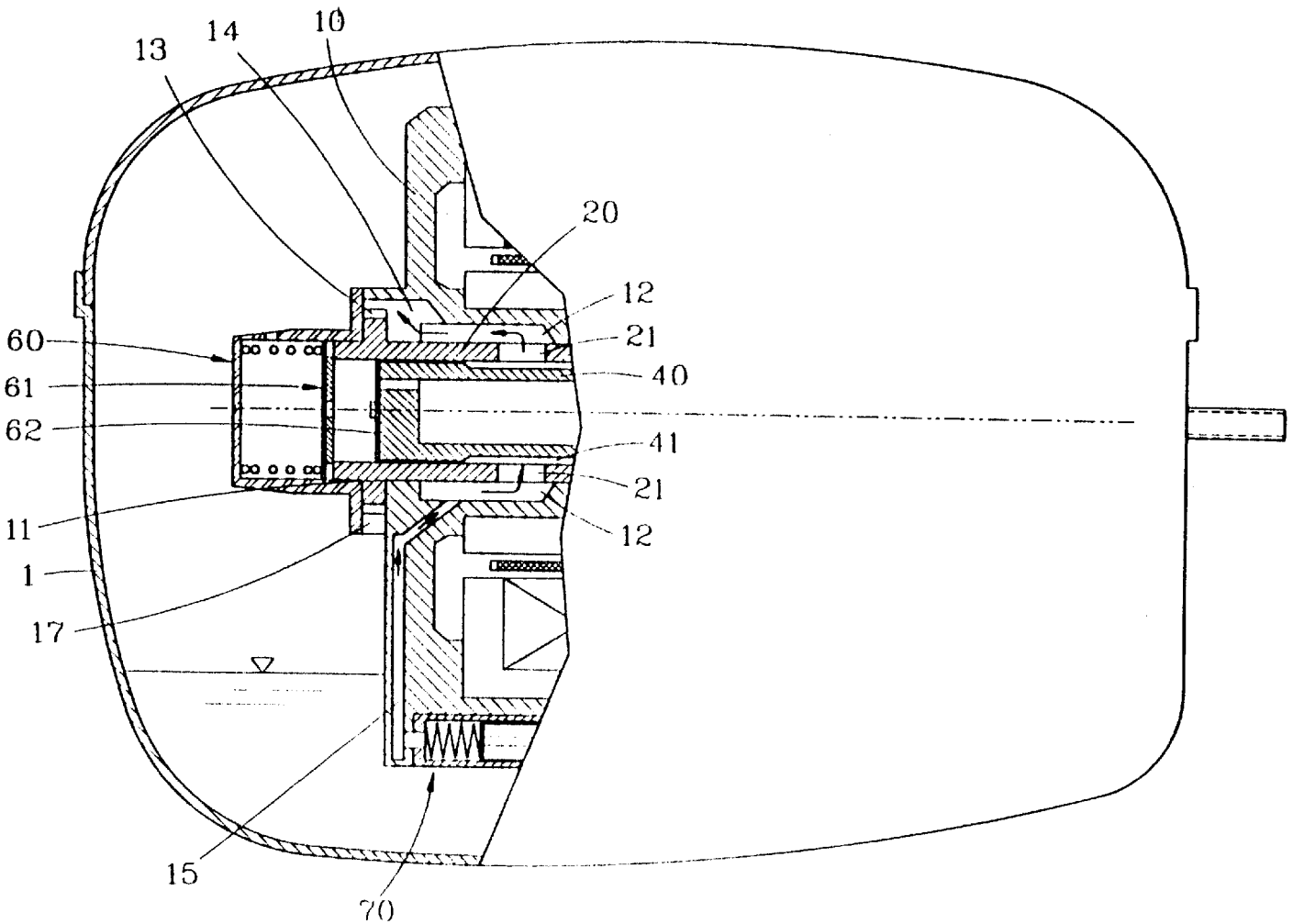
FIG. 2. is a front view of the conventional linear compressor which partially illustrates a cross-sectional view of an oil supply system of the conventional linear compressor.
Figure 3:
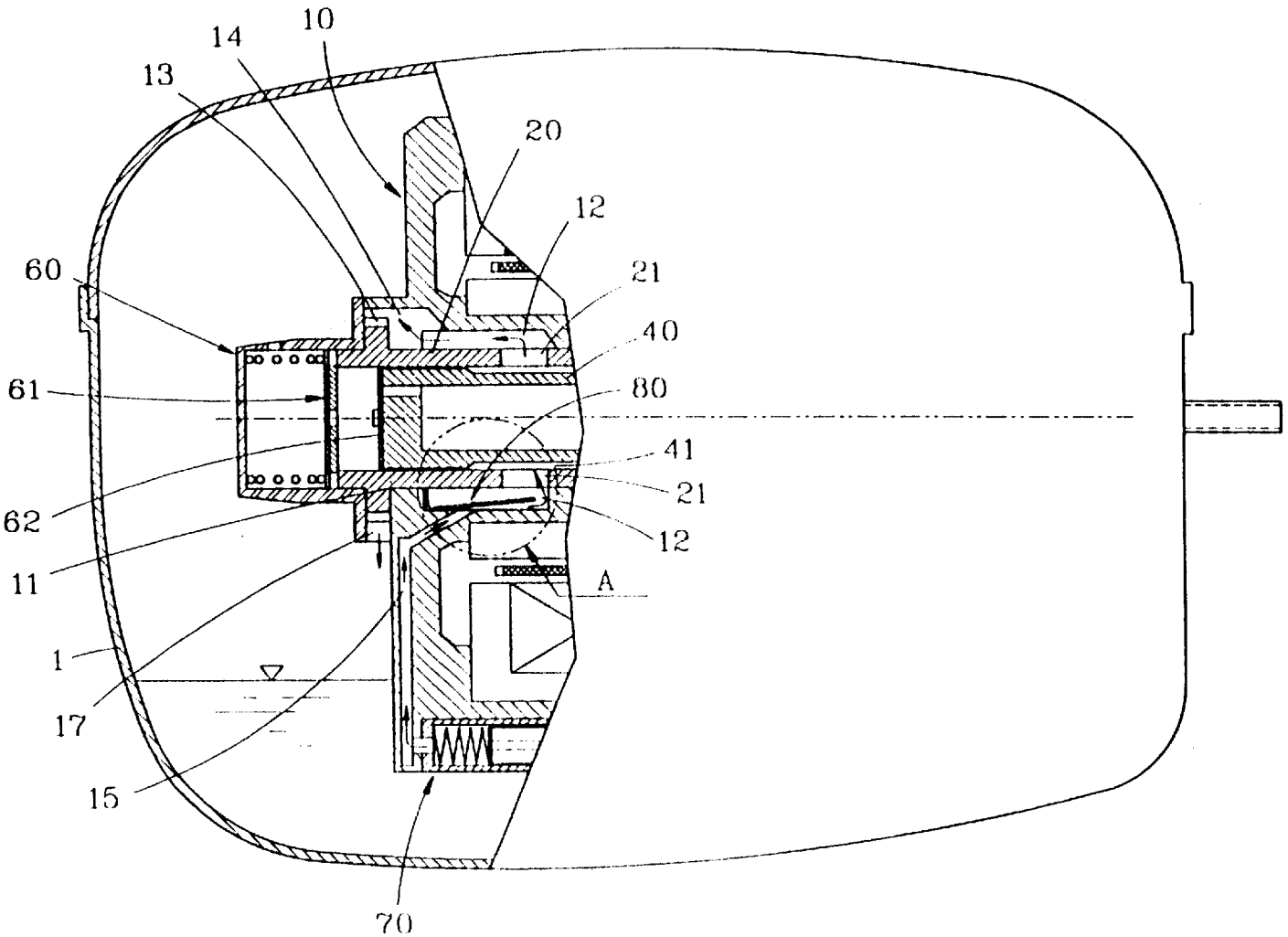
FIG. 3 is a front view sectionally illustrating a part of a linear compressor according to the present invention.

As shown in FIG. 3, the opening and closing system for the oil path of the linear compressor according to the present invention is provided with a hermetic vessel 1 in which oil is filled at a bottom part thereof, a frame 10 disposed in the hermetic vessel 1, a cylinder 20 inserted into a through hole 11 formed in a portion of the frame, a piston 40 inserted to a portion of the cylinder 20 and reciprocating in accordance with the driving of a motor, an exhaust cover 60 engaged with a side portion of the cylinder 20 by covering the cylinder 20, and an oil supplier 70 disposed at a bottom part of the frame 10 for pumping out oil.

Further, the opening and closing system for the oil path of the linear compressor includes a first oil groove 12 formed on a portion of an inner circumferential surface of the through hole 11 in the frame 10, a second oil groove 41 formed on a portion of an outer circumferential surface of the piston 40, an oil pass hole 21 penetratingly formed in the cylinder 20 so that the first oil groove 12 communicates with the second oil groove 41, a ring-shaped oil circular path 13 formed by an outer circumferential portion of the cylinder 20, the through hole 11 in the frame 10 and the exhaust cover 60, an oil communicating path 14 which communicates the oil circular path 13 to the first oil groove 12, an oil discharge hole 17 which communicates with the oil circular path 13 so as for the oil which has circulated through the oil circular path 13 to return to the hermetic vessel 1, an oil inflow path 15 which communicates a discharge side of the oil supplier 70 to the first oil path 12 so that the oil pumped out by the oil supplier 70 is flowed to the first oil groove 12, and a switching means 80, 180, 280 provided at the first oil groove 12, the switching means enabling the oil from the oil inflow path 15 to flow to the side of the first oil groove 12 during the operation of the compressor and blocking out the oil flowed into the first oil groove 12 when the compressor is not active so that the oil is not flowed into the oil inflow path 15 due to its self weight.

More specifically, since the first oil groove 12 is formed on the specific portion of the inner circumferential surface of the through hole 11 at predetermined size, when the cylinder 20 is inserted into the through hole 11 of the frame 10, the first oil groove 12 takes the shape of a ring with the periphery of the cylinder 20, an upper part of the ring-shaped first oil groove 12 communicating with the oil communicating path 14 while a lower part thereof communicating with the oil inflow path 15.

Further, the oil path hole 21 which communicates with first oil groove 12 is formed in a predetermined portion of the cylinder 20.

Figure 4:
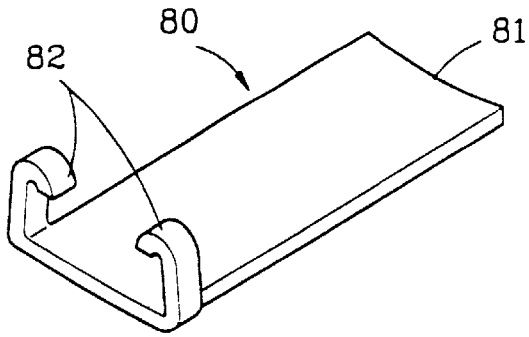
FIG. 4 is a perspective view illustrating a first embodiment of an switching means of an opening and closing system for an oil path of the linear compressor according to the present invention.
Figure 5:
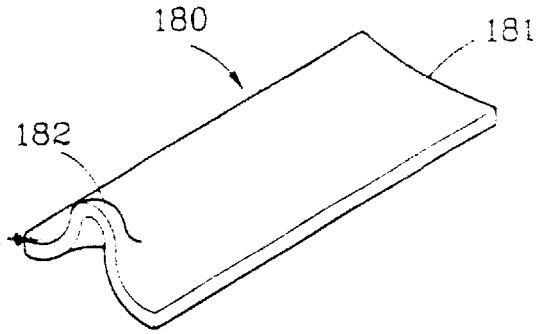
FIG. 5 is a perspective view illustrating a second embodiment of a switching means of the opening and closing system for the oil path of the linear compressor according to the present invention.
Figure 6:
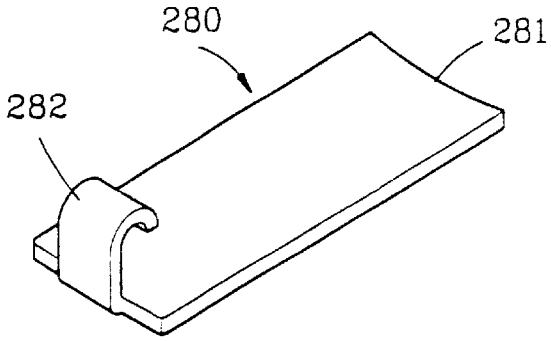
FIG. 6 is a perspective view illustrating a third embodiment of a switching means of the opening and closing system for the oil path of the linear compressor according to the present invention.

FIGS. 4 through 6 respectively illustrate various kinds of the switching means 80, 180, 280. As shown therein, the switching means 80, 180, 280 consists of a plate 81, 181, 281 having predetermined thickness and size and curvedly formed with curvature corresponding to an inner circumferential surface of the first oil groove 12 and at least one hinge protrusion 82, 182, 282 formed at a side portion of the plate 81, 181, 281 and serving as a hinge by being tightly stuck to a portion of the outer circumferential surface of the cylinder 20. Thus, when the switching means 80, 180, 280 is inserted to the first oil groove 12, the plate 81, 181, 281 blocks the oil inflow path 15 and the hinge protrusion 82, 182, 282 is closely fixed to the portion of the outer circumferential surface of the cylinder 20.

Specifically, as shown in FIG. 4, a first embodiment of the switching means consists of a plate 81 having predetermined thickness and size and curvedly formed with the curvature corresponding to the inner circumferential surface of the first oil groove 12 and the hinge protrusion 82 consisting of a couple of portions upwardly protruded from both ends of one side portion of the plate 81 at a predetermined length, each end of the portions of the hinge protrusion 82 being curvedly formed. The ends of the two protruding parts are inwardly curved toward a longitudinal center line of the plate, respectively, and curved facing to each other.

As shown in FIG. 5, a second embodiment of the switching means consists of a plate 181 having predetermined thickness and size and curvedly formed with the curvature corresponding to the inner circumferential surface of the first oil groove 12 and a hinge protrusion 182 formed by which a embossing is formed at the end of one side portion of the plate 181 at a predetermined height. Further, as shown in FIG. 6, a third embodiment of the switching means consists of a plate 281 having predetermined thickness and size and curvedly formed with the curvature corresponding to the inner circumferential surface of the first oil groove 12 and a hinge protrusion 282 upwardly protruded from a predetermined portion of the end of one side portion of the plate 281, an end portion of the hinge protrusion 282 being curvedly formed. The end portion of the hinge protrusion is inwardly curved inside of the plate.

In such opening and closing system for the oil path of the linear compressor according to the present invention, when an electric current is applied to the motor, the magnet 32 linearly reciprocates and the linear reciprocation effect accordingly is transmitted through the magnet frame 33 to the piston 40 which also accordingly reciprocates in the cylinder 20.

Here, the refrigerant gas which is flowed into the hermetic vessel 1 in accordance with the linear reciprocation of the piston 40 is flowed into the cylinder 20 through the refrigerant oil path F provided in the piston 40, compressed therein and then exhausted through the exhaust valve assembly 61 and the exhaust cover 60, the above process being repeatedly performed.

When the oil is pumped out in the oil supplier 70 by the vibrations generated in the process of which the compressor compresses the refrigerant gas while reciprocating, the pumped oil is flowed into the first oil groove 12 through the oil inflow path 15.

Figure 7A:
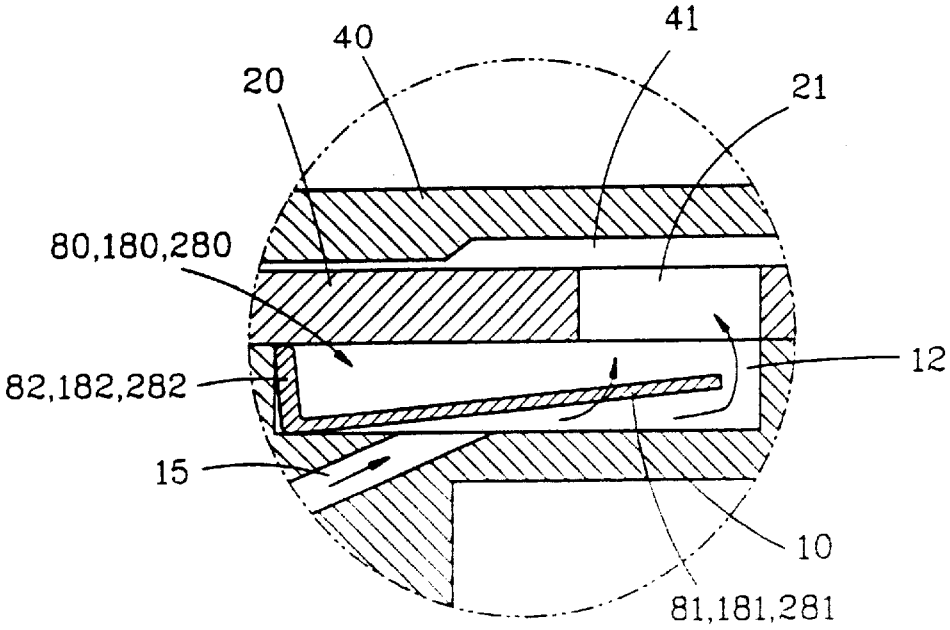
FIG. 7A is a cross-sectional view illustrating an oil flow state when the compressor is active in the opening and closing system for the oil path of the linear compressor according to the present invention.

Specifically, in the opening and closing system for the oil path in more detail, as shown in FIG. 7A, the switching means 80, 180, 280 opens the oil inflow path 15 while pivotally moving upon the hinge protrusion 82, 182, 282 by the pumping of the oil and thus the oil is flowed to the side of the first oil groove 12. Further, the oil flowed into the first oil groove 12 is continuously flowed to the oil pass hole 21 and then the second oil groove 41 to thereby be supplied between the piston 40 and the cylinder 20 for bringing to the lubricating and refrigerating effects.

In addition, the oil which has passed through the first and second oil grooves 12, 41 flows into the oil circular path 13 via the oil communicating path 14, then circulates through the oil circular path 13 and drops through the oil discharge hole 17 to the bottom part of the hermetic vessel 1 in which the predetermined amount of oil is filled and such oil continuously circulates by the above process.

Figure 7B:
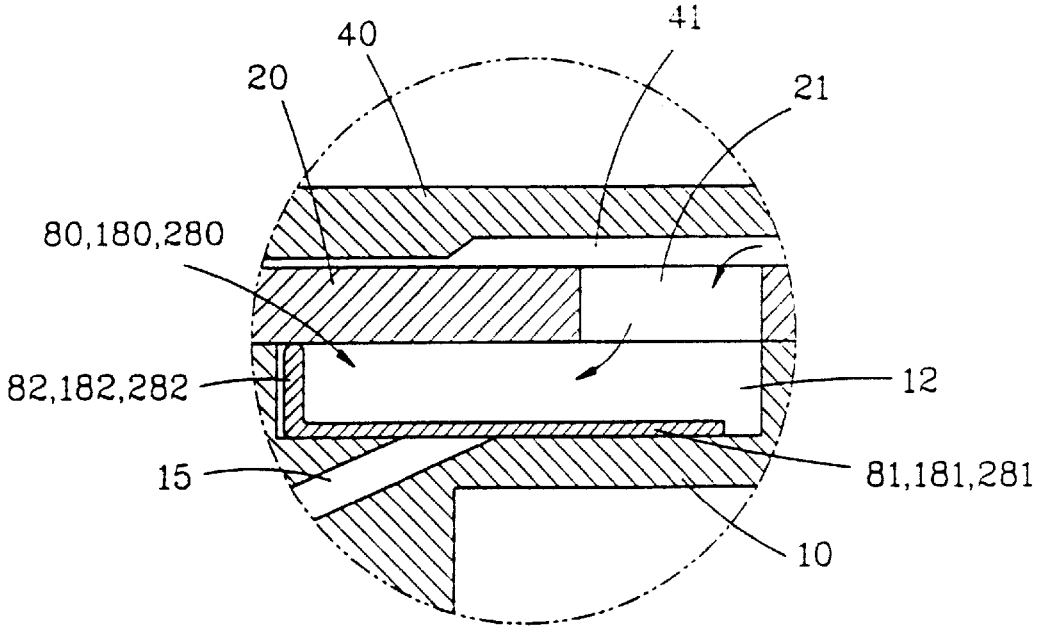
FIG. 7B is a cross-sectional view illustrating an oil flow state when the compressor is not active in the opening and closing system for the oil path of the linear compressor according to the present invention.

On the other hand, when the operation of the compressor is suspended, the oil pumping of the oil supplier 70 is accordingly stopped and thus the oil supplied between the piston 40 and the cylinder 20 returns to the bottom part of the hermetic vessel 1 due to its self weight. At this time, in the opening and closing system for the oil path as shown in FIG. 7B, since the switching means 80, 180, 280 pivotally moves upon the hinge protrusion 82, 182, 282 and thus blocks the oil inflow path 15 by its self weight, the oil returning to the bottom part of the hermetic vessel 1 remains in the first and second grooves 12, 41.

Accordingly, when the operation of the compressor resumes, the oil remaining in the first and second grooves 12, 41 lubricates portions, to be slid to each other, of the components disposed, for example, between the cylinder 20 and the piston 40 and also refrigerates the heat generated by the motor. Here, it is noted that it takes about 4 to 5 seconds for the oil filled in the bottom part of the hermetic vessel 1 to be supplied to the slid portions, and it takes about 16 seconds for the oil to return to the bottom part of the hermetic vessel 1 due to its self weight when suspending the operation of the compressor.

As described above, in the opening and closing system for the oil path of the linear compressor according to the present invention, the oil is smoothly supplied to the compressor during the operation. Further, since the supplied oil partly remains in the frame after suspending the operation of the compressor, the oil remaining therein serves as the lubricant for the components, for example, between the cylinder and the piston in the resumption of the operation of the compressor for thereby preventing the abrasion and friction loss of the components which may occur in the initial state of the re-operation and eventually improving the compression efficiency. In addition, since the switching means opens by the oil pressure and thus the oil is supplied to the friction surfaces of the components in the normal operation of the compressor, and the switching means keeps the leaking refrigerant from being flowed backward to the oil supplier, although the leaking refrigerant at the high pressure is flowed to the oil path, the opening and closing system for the oil path according to the present invention prevents the noise caused by the leakage of the high-pressure refrigerant gas.

It will be apparent to those skilled in the art that various modifications and variations can be made in the opening and closing system for the oil path of the linear compressor of the present invention without departing from the spirit or scope of the invention. Thus, it is intended that the present invention cover the modifications and variations of this invention provided they come within the scope of the appended claims and their equivalents.

What is claimed is:

1. An opening and closing system for an oil path of a linear compressor, comprising:

a hermetic vessel in which oil is filled in a bottom part thereof;

a frame disposed in the hermetic vessel and communicating with a first oil groove and a second oil groove;

a cylinder inserted into a through hole formed in a predetermined portion of the frame;

a piston linearly reciprocating by the driving of a motor by being inserted into the cylinder, the second oil groove being formed on a portion of an outer circumferential surface of the piston;

an exhaust cover coupled to one side of the cylinder;

an oil supplier disposed at the frame for pumping out oil and communicating with the first oil groove through an oil inflow path; and a switch provided between the first oil groove and the oil inflow path for opening and closing the oil inflow path.

2. The opening and closing system for the oil path of the linear compressor according to claim 1, wherein the switch comprises a plate having predetermined thickness and size and curvedly formed with a curvature corresponding to an inner circumferential surface of the first oil groove and at least one hinge protrusion formed at a side portion of the plate and serving as a hinge by being tightly stuck to a portion of an outer circumferential surface of the cylinder.

3. The opening and closing system for the oil path of the linear compressor according to claim 2, wherein the hinge protrusion comprises two parts upwardly protruded from both ends of one side portion of the plate at a predetermined length, each end of the parts thereof being curved.

4. The opening and closing system for the oil path of the linear compressor according to claim 3, wherein the ends of the two protruding parts are inwardly curved toward a longitudinal center line of the plate, respectively.

5. The opening and closing system for the oil path of the linear compressor according to claim 4, wherein the ends of the two protruding part are curved facing to each other.

6. The opening and closing system for the oil path of the linear compressor according to claim 2, wherein the hinge protrusion is formed by an embossing formed at the end of one side portion of the plate at a predetermined height.

7. The opening and closing system for the oil path of the linear compressor according to claim 2, wherein the hinge protrusion is upwardly protruded from a predetermined part of the end of one side portion of the plate, an end portion of the hinge protrusion being curved.

8. The opening and closing system for the oil path of the linear compressor according to claim 7, wherein the end portion of the hinge protrusion is inwardly curved inside of the plate.

9. A linear compressor comprising:

a frame having inner walls forming a cylindrical through hole, the inner walls having a frame groove formed at an inner surface thereof, the frame groove being connected with an opening of an oil flow path formed within the frame;

a hollow cylinder positioned within the through hole of the frame, the cylinder having an oil pass hole formed through a lateral surface thereof;

a piston positioned within the cylinder, the piston having a piston groove formed at a lateral outer surface thereof; and a switch located within the frame groove to operatively open or close the oil inflow path of the frame;

whereby the oil inflow path, the frame groove, the oil pass hole, and the piston groove create an inflow passage for oil being regulated by the switch.

10. The linear compressor of claim 9, wherein, the frame has an opposing frame groove formed at an inner surface of the inner walls opposing the frame groove, the opposing frame groove being connected with an oil outflow path formed within the frame;

the cylinder has an opposing oil pass hole formed through a lateral surface of the hollow cylinder opposing the oil pass hole; and the piston has an opposing piston groove formed at a lateral outer surface of the piston opposing the piston oil groove;

whereby the oil outflow path, the opposing frame groove, the opposing oil pass hole and the opposing piston oil groove create an outflow passage for oil.

11. The linear compressor of claim 9, wherein the switch comprises:

a curved plate having a curvature corresponding to that of the frame groove, and having a length sufficient to cover the opening of the oil inflow path; and a protrusion formed at one end of the curved plate, the protrusion contacting with an outer lateral surface of the cylinder to act as a hinge at which the curved plate moves to open or close the oil inflow path according to a flow of oil passing therethrough.

12. A linear compressor comprising:

a frame having inner walls forming a cylindrical through hole, the inner walls having a frame groove formed at an inner surface thereof, the frame groove connected with an opening of an oil inflow path formed within the frame;

an oil supplier connected to the frame for supplying oil into the oil inflow path;

a hollow cylinder positioned within the through hole of the frame;

a piston operatively connected to frame and positioned within the cylinder; and a valve located within the frame groove to operatively open or close the opening of the oil inflow path of the frame according to a flow of oil being supplied by the oil supplier.

* * * * *